US005436404A

United States Patent [19]

Shimada

[11] Patent Number: 5,436,404

[45] Date of Patent: Jul. 25, 1995

[54] AUTO-PLAY APPARATUS FOR GENERATION OF ACCOMPANIMENT TONES WITH A CONTROLLABLE TONE-UP LEVEL

[75] Inventor: Yoshihisa Shimada, Hamamatsu, Japan

[73] Assignee: Kabushiki Kaisha Kawai Gakki Seisakusho, Shizuoka, Japan

[21] Appl. No.: 47,424

[22] Filed: Apr. 15, 1993

[30] Foreign Application Priority Data

Apr. 17, 1992 [JP] Japan ..... 4-124240

[51] Int. Cl.[6] ..... G10H 1/06; G10H 1/38; G10H 1/46

[52] U.S. Cl. ..... 84/610; 84/613; 84/622; 84/633; 84/DIG. 22

[58] Field of Search ..... 84/609-620, 84/622-625, 633-638, DIG. 22

[56] References Cited

U.S. PATENT DOCUMENTS 4,646,609 3/1987 Teruo et al. ..... 84/609 X
5,220,118 6/1993 Konishi ..... 84/609
5,260,509 11/1993 Shimada et al. ..... 84/622

*Primary Examiner*—Stanley J. Witkowski

*Attorney, Agent, or Firm*—Birch, Stewart, Kolasch & Birch

[57] ABSTRACT

An auto-play apparatus having an auto-play data memory for storing a note data string of an auto-accompaniment pattern, and a tone generator for generating tones on the basis of the note data string read out from the auto-play data memory. The auto-play apparatus includes an intonation pattern memory for storing intonation patterns of a plurality of levels corresponding to different degrees of tone-up of a performance. The intonation value is changed upon operation of an operation unit, and a note data string is read out from the auto-play data memory on the basis of intonation pattern data corresponding to the new intonation value. The readout note data string is supplied to the tone generator. The intonation pattern data of different levels includes at least designation information for designating different read positions in the auto-play data memory, and different tone volume information, different tone color information, and different instrument information to be provided to the readout note data. The intonation pattern data is partially rewritten in a data edit mode, thus changing the tone-up pattern of an accompaniment.

9 Claims, 28 Drawing Sheets

SUB-PHRASE SELECTOR
10
INTONATION OPERATION
12
INTONATION VALUE SETTING
11
RHYTHM SELECTOR
13
INTONATION PATTERN
14
14a
14b
1
0
1
2
0~15
3
0~15
INTONATION LEVEL n
VOL
COLOR
INSTRUMENT
PATTERN
SUB-PHRASE PATTERN
EDIT OPERATION
19
KEYBOARD SWs
20
RAM
21
TONE CONT
15
WAVE-FORM ROM
18
TONE GEN
17
AUTO-ACCOMPANIMENT DATA
16
1
K
S
G
V
2
3
D/A
22
23
24

FIG. 3

| RHYTHM | INTONATION PRESET VALUE |
|---|---|
| 1 | 2 |
| 2 | 4 |
| 3 | 3 |
| ---- | ---- |

31

FIG. 4

| RHYTHM | INTONATION PATTERN | | | | |
|---|---|---|---|---|---|
| | 0 | 1 | 2 | ------ | 15 |
| 1 | | | | ------ | |
| 2 | | | | ------ | |
| 3 | | | | ------ | |
| ---- | | | | ------ | |

14a

32

FIG. 5

| | | |
|---|---|---|
| | INT0 | INT1 |
| | | |

| | | |
|---|---|---|
| | INT2 | INT3 |
| | | |

| | | |
|---|---|---|
| | INT4 | INT5 |
| | | |

| | | |
|---|---|---|
| | INT6 | INT7 |
| | | |

| | | |
|---|---|---|
| | INT8 | INT9 |
| | INTRO. PATTERN | |

| | | |
|---|---|---|
| | INTA | INTB |
| | SOFT FILL-IN PATTERN | |

| | | |
|---|---|---|
| | INTC | INTD |
| | LAUD FILL-IN PATTERN | |

| | | |
|---|---|---|
| | INTE | INTF |
| | ENDING PATTERN | |

FIG. 6

| | INTONATION 0 | | | | | | | | | | |
|---|---|---|---|---|---|---|---|---|---|---|---|
| | VELO | COLOR/ INST. | PATTERN | | | | | | | | |
| | | | 1.0 | 1.2 | 2.0 | 2.2 | 3.0 | 3.2 | 4.0 | 4.2 | REP |
| CHORD | 00H | 01H,NC | 0000H | | 0001H | | 0002H | | 0003H | | REP |
| BASS | 00H | 40HNC | 0100H | | | | 0101H | | | | REP |
| DRUM1 | 00H | 00H,00H | 1000H | REP | | | | | | | |
| DRUM2 | 00H | 00H,00H | 1100H | | 1101H | | 1102H | | 1103H | | REP |
| DRUM3 | 00H | 00H,00H | 1200H | | 1201H | | 1202H | | 1203H | | REP |

| | INTONATION 2 | | | | | | | | | | |
|---|---|---|---|---|---|---|---|---|---|---|---|
| | VELO | COLOR/ INST. | PATTERN | | | | | | | | |
| | | | 1.0 | 1.2 | 2.0 | 2.2 | 3.0 | 3.2 | 4.0 | 4.2 | REP |
| CHORD | 00H | 01H,NC | 0000H | | 0001H | | 0002H | | 0003H | | REP |
| BASS | 00H | 40HNC | 0102H | | | | 0103H | | | | REP |
| DRUM1 | 00H | 26H,28H | 1000H | REP | | | | | | | |
| DRUM2 | 00H | 00H,00H | 1100H | | 1101H | | 1102H | | 1103H | | REP |
| DRUM3 | 00H | 00H,00H | 1200H | | 1201H | | 1202H | | 1207H | | REP |

FIG. 7

| | INTONATION 4 | | | | | | | | | | |
|---|---|---|---|---|---|---|---|---|---|---|---|
| | VELO | COLOR/ INST. | PATTERN | | | | | | | | |
| | | | 1.0 | 1.2 | 2.0 | 2.2 | 3.0 | 3.2 | 4.0 | 4.2 | REP |
| CHORD | 00H | 20H,NC | 0000H | | 0001H | | 0002H | | 0003H | | REP |
| BASS | 00H | 40HNC | 0102H | | | | 0103H | | | | REP |
| DRUM1 | 00H | 26H,28H | 1000H | REP | | | | | | | |
| DRUM2 | 20H | 24H,25H | 1100H | | 1101H | | 1102H | | 1103H | | REP |
| DRUM3 | 00H | 00H,00H | 1200H | | 1201H | | 1202H | | 1203H | | REP |

| | INTONATION 6 | | | | | | | | | | |
|---|---|---|---|---|---|---|---|---|---|---|---|
| | VELO | COLOR/ INST. | PATTERN | | | | | | | | |
| | | | 1.0 | 1.2 | 2.0 | 2.2 | 3.0 | 3.2 | 4.0 | 4.2 | REP |
| CHORD | 20H | 20H,NC | 0004H | | 0005H | | 0006H | | 0007H | | REP |
| BASS | 20H | 40HNC | 0104H | | | | 0105H | | | | REP |
| DRUM1 | 20H | 26H,28H | 1000H | REP | | | | | | | |
| DRUM2 | 20H | 24H,25H | 1104H | | 1105H | | 1106H | | 1107H | | REP |
| DRUM3 | 20H | 00H,00H | 1204H | | 1205H | | 1206H | | 1207H | | REP |

FIG. 12

35

INTONATION No.

| RHYTHM No. | 0 | 1 | 2 | 3 | 4 | 5 | 6 | 7 | 8 | 9 | A | B | C | D | E | F |
|---|---|---|---|---|---|---|---|---|---|---|---|---|---|---|---|---|
| 96 | 0 | 1 | 1 | 0 | | | | | | | | | | | | |
| 97 | 0 | 0 | 0 | 0 | | | | | | | | | | | | |
| 98 | 1 | 1 | 0 | 0 | | | | | | | | | | | | |
| 99 | | | | | | | | | | | | | | | | |
| 100 | | | | | | | | | | | | | | | | |

1: EDITED
0: NOT EDITED

AUTO-PLAY APPARATUS FOR GENERATION OF ACCOMPANIMENT TONES WITH A CONTROLLABLE TONE-UP LEVEL

BACKGROUND OF THE INVENTION

1. Field of the Invention

The present invention relates to an auto-play apparatus for an electronic musical instrument, which performs an auto-play according to the degree of tone-up (intonation) of a performance.

2. Description of the Prior Art

In an electronic keyboard (e.g., an electronic piano), auto-accompaniment patterns (tone generation note data) such as introduction, fill-in, normal, ending patterns, and the like are stored in advance, and a switch for selecting one of these patterns is operated in correspondence with the process of a music piece (tone-up condition), thereby inserting a phrase corresponding to the selected pattern during a performance.

When a fixed, i.e., pre-programmed auto-accompaniment pattern is inserted during a performance, the flow of performance becomes discontinuous, and this may disturb the tone-up state of the performance. More specifically, it is difficult to gradually change the tone volume or rhythm of accompaniment tones according to the tone-up state of the performance.

SUMMARY OF THE INVENTION

It is an object of the present invention to provide an auto-play apparatus which obtains auto-accompaniment tones according to the degree of tone-up by designating the degree of tone-up of a performance, and can easily develop a basic auto-accompaniment pattern by a simple operation.

It is another object of the present invention to provide an auto-play apparatus, which can desirably set an auto-accompaniment pattern according to the degree of tone-up by editing auto-accompaniment data, so that a performance can be toned up according to a player's preference.

An auto-play apparatus according to the present invention comprises note data memory means for storing a note data string of an auto-accompaniment pattern, tone generation means for generating tones on the basis of the note data string read out from the note data memory means, intonation pattern memory means for storing intonation patterns of a plurality of levels corresponding to degrees of tone-up of a performance, intonation value setting means for setting intonation values corresponding to the plurality of levels, and tone control means for controlling the note data string read out from the note data memory means on the basis of intonation pattern data corresponding to the set intonation values, and outputting the note data string to the tone generation means, wherein the intonation pattern data of different levels include one or a plurality of designation information for designating different read positions on the note data memory means, and different tone volume information, different tone color information, and different instrument information to be given to the readout note data, and the tone control means includes edit means for correcting the intonation pattern data.

An automatic play pattern can be desirably controlled by controlling the intonation levels. When intonation patterns of different levels are set in advance so that they are gradually changed in correspondence with the degree of tone-up of a performance, an auto-accompaniment play can be gradually toned up since the intonation levels are changed stepwise. In an edit operation, note data need not be directly edited, and accompaniment information having a different degree of tone up can be easily formed by partially rewriting the intonation data, e.g., designation information of a tone volume, a tone color, or the like.

BRIEF DESCRIPTION OF THE DRAWINGS

FIG. 3 shows a memory table of intonation preset values;

FIG. 4 shows a memory table of intonation pattern data;

FIG. 5 shows data formats of intonation pattern data;

FIG. 6 shows data arrangements of the intonation pattern data;

FIG. 7 shows data arrangements of the intonation pattern data;

FIG. 12 shows an intonation edit table;

DETAILED DESCRIPTION OF THE PREFERRED EMBODIMENT

Figure 1:
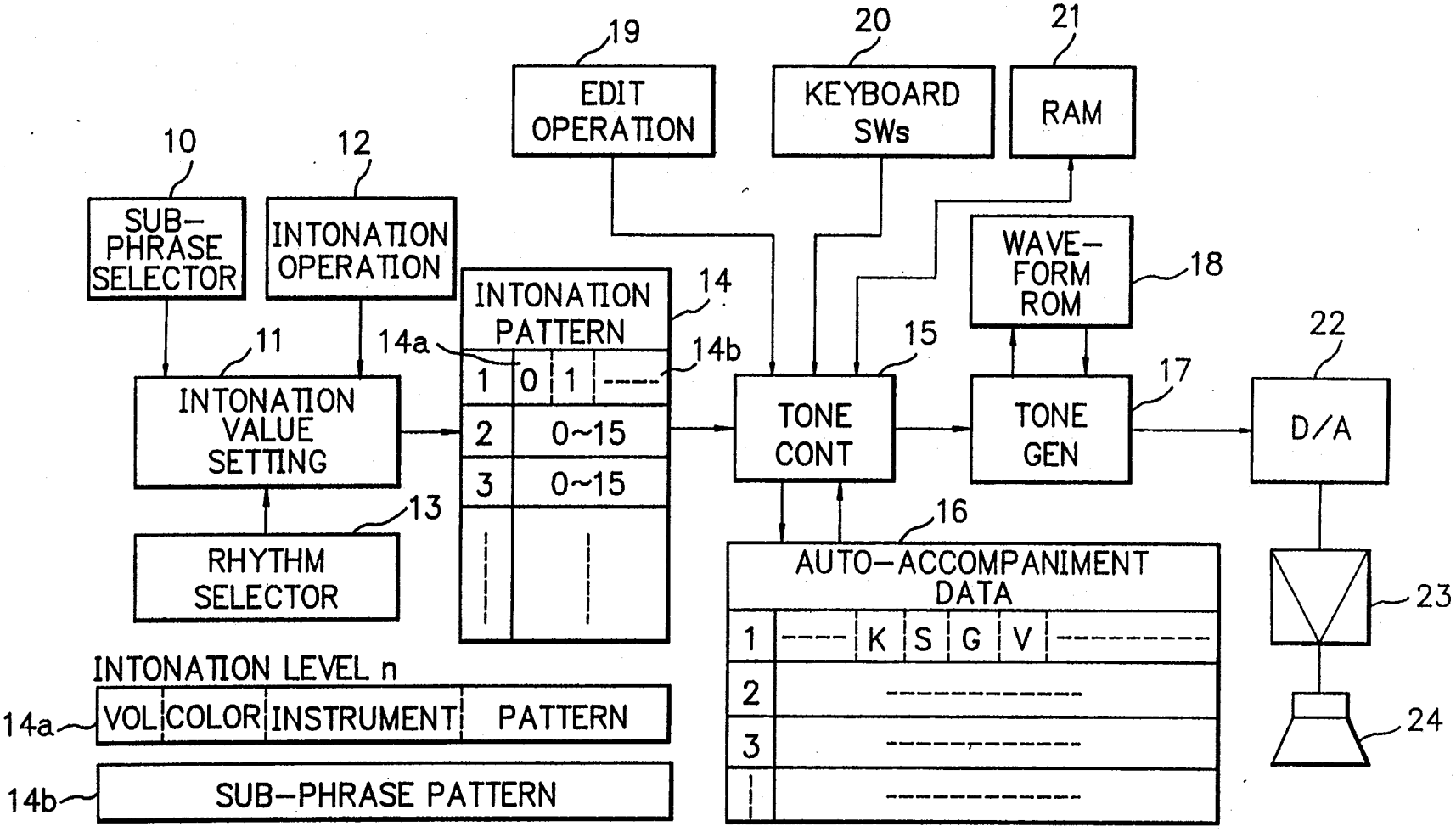
FIG. 1 is a block diagram showing an electronic musical instrument according to an embodiment of an auto-play apparatus of the present invention.
Figure 2:
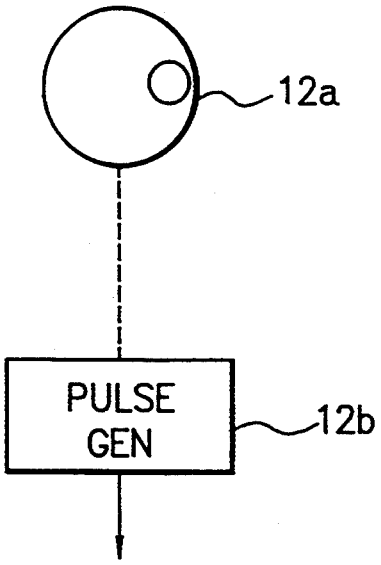
FIG. 2 is a block diagram showing elements of an intonation operation unit.

FIG. 1 is a block diagram showing main part of an electronic musical instrument according to an embodiment of the present invention. Keyboard switches 20 are turned on/off according to an operation on a keyboard, and supply corresponding note information of a performance to a tone control unit 15 comprising a CPU. An edit operation unit 19 comprises operation switches on an operation panel, and is used for an edit operation. An intonation operation unit 12 comprises an intonation dial 12*a* and a pulse generator 12*b* coupled to a dial shaft, as shown in FIG. 2, and supplies, to an intonation value setting unit 11, information as a predetermined number of pulses corresponding to a degree of tone-up of a performance designated upon operation of the dial.

A sub-phrase selector 10 comprises operation switches on the operation panel, and is used for selecting auto rhythm accompaniment patterns such as introduction, fill-in, normal, ending patterns, and the like prestored in correspondence with intonation values. Different auto rhythm accompaniment patterns are prepared in units of rhythms such as tango, waltz, and the like, and when a desired rhythm is selected upon operation of a rhythm selector 13 on the operation panel, an intonation pattern corresponding to the selected rhythm is determined. Selection information from the sub-phrase selector 10 and the rhythm selector 13 is supplied to the intonation value setting unit 11.

The intonation value setting unit 11 outputs information such as an intonation value, a rhythm number, and the like to an intonation pattern memory (ROM) 14 on the basis of operation information from the sub-phrase selector 10, the intonation operation unit 12, and the rhythm selector 13. In this embodiment, sub-phrases such as fill-in phrases, introduction phrases, and the like are prepared in correspondence with intonation values. The intonation pattern memory 14 stores auto rhythm accompaniment pattern data in correspondence with the selected rhythm and the intonation value set upon operation of the intonation operation unit. The auto rhythm accompaniment pattern data is accompaniment control data for generating rhythm accompaniment tones by cyclically reading out an auto-accompaniment note data string pre-programmed in a ROM 16.

The tone control unit 15 comprising a CPU supplies note information corresponding to keyboard operations, and parameter information such as a rhythm, tone color, and the like corresponding to panel switch operations to a tone generator 17. The tone generator 17 reads out PCM sound source data from a waveform ROM 18 on the basis of the input information, processes the amplitude and envelope of the readout data, and outputs the processed data to a D/A converter 22. A tone signal obtained from the D/A converter 22 is supplied to a loudspeaker 24 via an amplifier 23.

The ROM 16 is written with auto-accompaniment data. The tone control unit 15 repetitively reads out auto-accompaniment note data for about one to two bars from the ROM 16 on the basis of auto rhythm accompaniment pattern data supplied from the intonation pattern memory 14, and supplies the readout data to the tone generator 17. The tone generator 17 reads out waveform data of, e.g., chord tones, bass tones, drum tones, and the like corresponding to the auto-accompaniment data from the ROM 18, and supplies the readout data to the D/A converter 22. Therefore, chord tones, bass tones, drum tones, and the like of an auto rhythm accompaniment are obtained from the loudspeaker 24 via the amplifier 23 together with, e.g., piano tones generated in correspondence with key operations.

The intonation value setting unit 11 has an intonation preset table 31, as shown in FIG. 3. The table 31 has intonation preset values in units of types of rhythms. For example, a value "2" is given as an intonation level for rhythm No. 1. The intonation value setting unit 11 increases/decreases the intonation preset value according to the dial operation, and supplies the intonation value and rhythm number to the intonation pattern memory 14.

The intonation pattern memory 14 has an intonation pattern table 32 having a plurality of levels (e.g., 16 levels from 0 to 15) corresponding to intonation values in units of rhythms, as shown in FIG. 4. Therefore, intonation pattern data of a predetermined level corresponding to the selected rhythm and the designated intonation value is read out from the memory 14, and is supplied to the tone control unit 15. For example, if the selected rhythm number is "1", and the intonation value is "2", intonation pattern data 14*a* of corresponding level "2" is read out.

The intonation pattern data is partially used as a sub-phrase pattern 14*b*. The sub-phrase pattern 14*b* is read out when a sub-phrase (short phrase) such as an introduction phrase, a fill-in phrase, an ending phrase, or the like is to be inserted during a performance.

FIG. 5 shows an arrangement of intonation pattern data in one rhythm. Sixteen intonation pattern data are arranged in the order of intonation values INT0 to INTF (F=15) corresponding to intonation levels. The intonation pattern data having the intonation values INT0 to INT7 are used for generating rhythm accompaniment tones corresponding to the intonation levels. The intonation pattern data having the intonation values INT8 to INTF are used as sub-phrase patterns consisting of an introduction pattern, a soft fill-in pattern, a loud fill-in pattern, and an ending pattern.

FIGS. 6 and 7 show in detail the formats of intonation pattern data. The intonation pattern data of one level is constituted by five tracks (channels) of data including chord, bass, and drum1 to drum3 tracks. Each track consists of a tone volume difference value VELO, tone color/instrument designation data, and play pattern data. Therefore, these data can be changed or designated in units of tracks.

The 1-byte tone volume difference value VELO is a value to be added to a tone volume value of each tone of auto-accompaniment data. With this difference value, the tone volume value of auto-accompaniment data is changed, and an accent (tone volume level) can be given in units of tones of each track. For example, in the tracks of intonation pattern data of levels "0" and "2" in FIG. 6, the tone volume difference values are "0". The tone volume difference value of the drum2 track of intonation pattern data of level "4" shown in FIG. 7 is 20H (H represents hexadecimal notation). Therefore, the tone volume of the drum2 track is increased at intonation level "4". The tone volume difference values of all tracks of intonation pattern data of level "6" shown in FIG. 7 are 20H, and the tone volumes of the respective accompaniment parts are increased by 20H.

The 2-byte tone color/instrument designation data is tone color/instrument change designation information. In chord and bass tracks, a 1-byte tone color parameter is given, and another 1 byte is not used (NC). In FIGS. 6 and 7, the tone color parameters in the chord and bass tracks are respectively 01H and 40H at intonation levels "0" and "2", and they are respectively changed to 20H and 40H at intonation levels "4" and "6".

In each of the drum1 to drum3 tracks, 2-byte instrument conversion information is given. In general, as note information of a drum track, scale data (key data) is assigned as instrument information. For example, "C"

is assigned to a bass drum, "D" is assigned to a snare drum, and "E" is assigned to a high hat. At intonation level "2" in FIG. 6, data "26H, 28H" is stored in the drum1 track. This data indicates conversion of 26H (close high hat) in auto-accompaniment note data in the ROM 16 into 28H (open high hat). Therefore, even when identical note data is used, drum tones of different instruments can be generated according to the intonation levels.

In the three tracks of drum channels, different instruments can be assigned. Since an instrument can be changed in units of tracks, intonation patterns can be changed with a large degree of freedom according to the intonation levels. Since each drum track can access common note data, the amount of note data can be prevented from being greatly increased even if the number of drum channels is increased.

A play pattern portion of intonation pattern data includes of four bars of note designation information. The note designation information is address data indicating a specific position of note data in the ROM 16 in practice. One bar includes of four beats, and for example, 1.0 and 1.2 respectively represent the first and third beats of one bar. For example, in a chord track of intonation level "0", the playback operation of notes for four beats of the first bar progresses from address 0000H of note data, and in the second bar, the playback operation of notes progresses from address 0001H. At the end of the fourth bar, a repeat mark REP is recorded. When the playback operation progresses to this symbol, it returns to the top address.

When note designation information in the play pattern portion is changed, a play pattern can be easily changed. For example, at intonation level "0", 0100H and 0101H are given as note designation information of the bass track. However, at level "2", these pieces of information are changed to 0102H and 0103H. Therefore, at level "2", the instrument type of the drum1 track is changed, and the play pattern of a bass line is also changed. In this manner, when the play pattern portion is partially changed, a different intonation level can be easily obtained.

At intonation level "4" shown in FIG. 7, the tone color in the chord track, the instruments in the drum1 and drum2 tracks, and the tone volume in the drum2 track are changed without changing the play pattern of level "2". At level "6", at least one of the tone volume, tone color, instrument, and play pattern of each track is changed. Level "6" indicates a considerable degree of tone-up of a performance.

Figure 8:
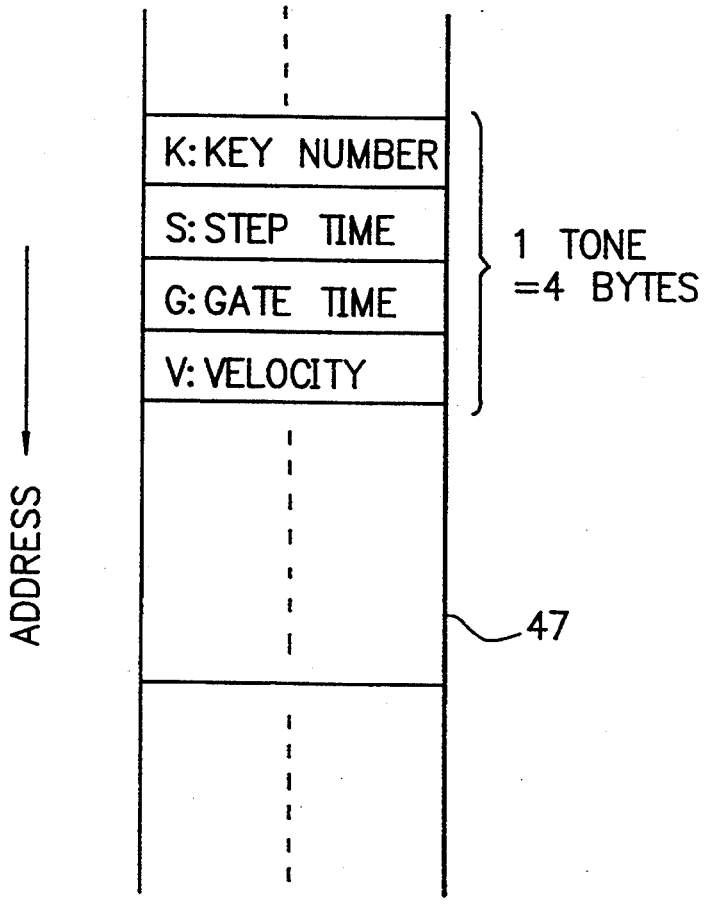
FIG. 8 shows formats of note data read out according to the intonation pattern data.

FIG. 8 partially shows note data accessed through intonation pattern data. One note of note data includes four bytes, i.e., a key number K, a step time S, a gate time G, and a velocity V. The key number K indicates a scale, the step time S indicates a tone generation timing, the gate time G indicates a tone generation duration, and the velocity V indicates a tone volume (key depression pressure) of a tone. Although not shown, note data also includes tone color data, a repeat mark of a note pattern, and the like.

The note data is sequentially read out in units of four bytes each from an address designated by the play pattern portion of the intonation pattern data from the ROM (auto-accompaniment data memory) 16. The tone control unit 15 shown in FIG. 1 performs read address control on the basis of intonation pattern data, modifies the tone volume and key number of the readout note data with tone volume and instrument designation data of the intonation pattern data, or changes the tone color, and outputs the modified note data to the tone generator 17.

Figure 9:
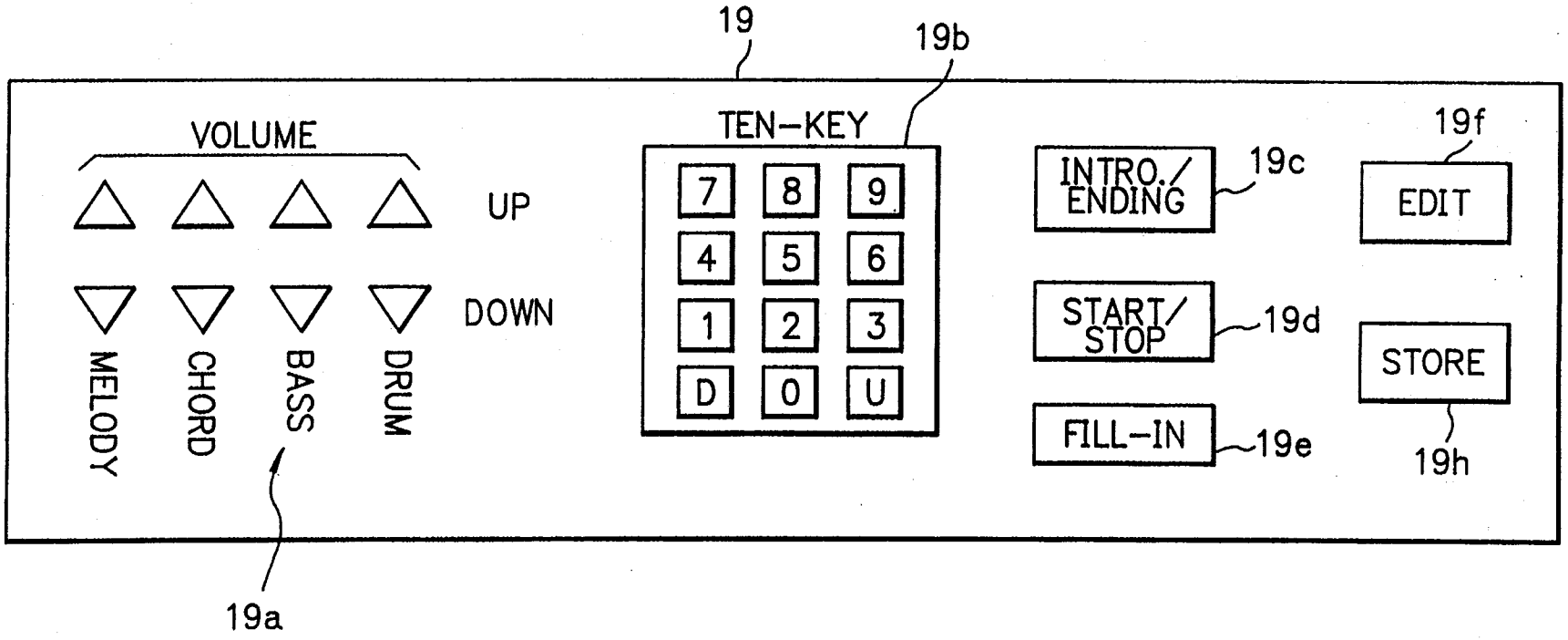
FIG. 9 is a plan view showing main part of an edit operation unit.

FIG. 9 is a plan view showing the edit operation unit 19 shown in FIG. 1. The edit operation unit 19 is provided with volume switches 19*a*, a ten-key pad 19*b*, and edit operation switches 19*c* to 19*h*, which are necessary for an edit operation. The volume switches 19*a* include up and down switches corresponding to the melody, chord, bass, and drum channels. The ten-key pad 19*b* is used for changing, e.g., a tone color number of a part, which is being edited, and includes 0 to 9 numeric keys, and up and down keys U and D for respectively continuously incrementing and decrementing numerical value data. The edit operation switches include the introduction/ending switch 19*c*, the start/stop switch 19*d*, the fill-in switch 19*e*, the edit switch 19*f*, and the store switch 19*h*.

Figures 10A, 10B:
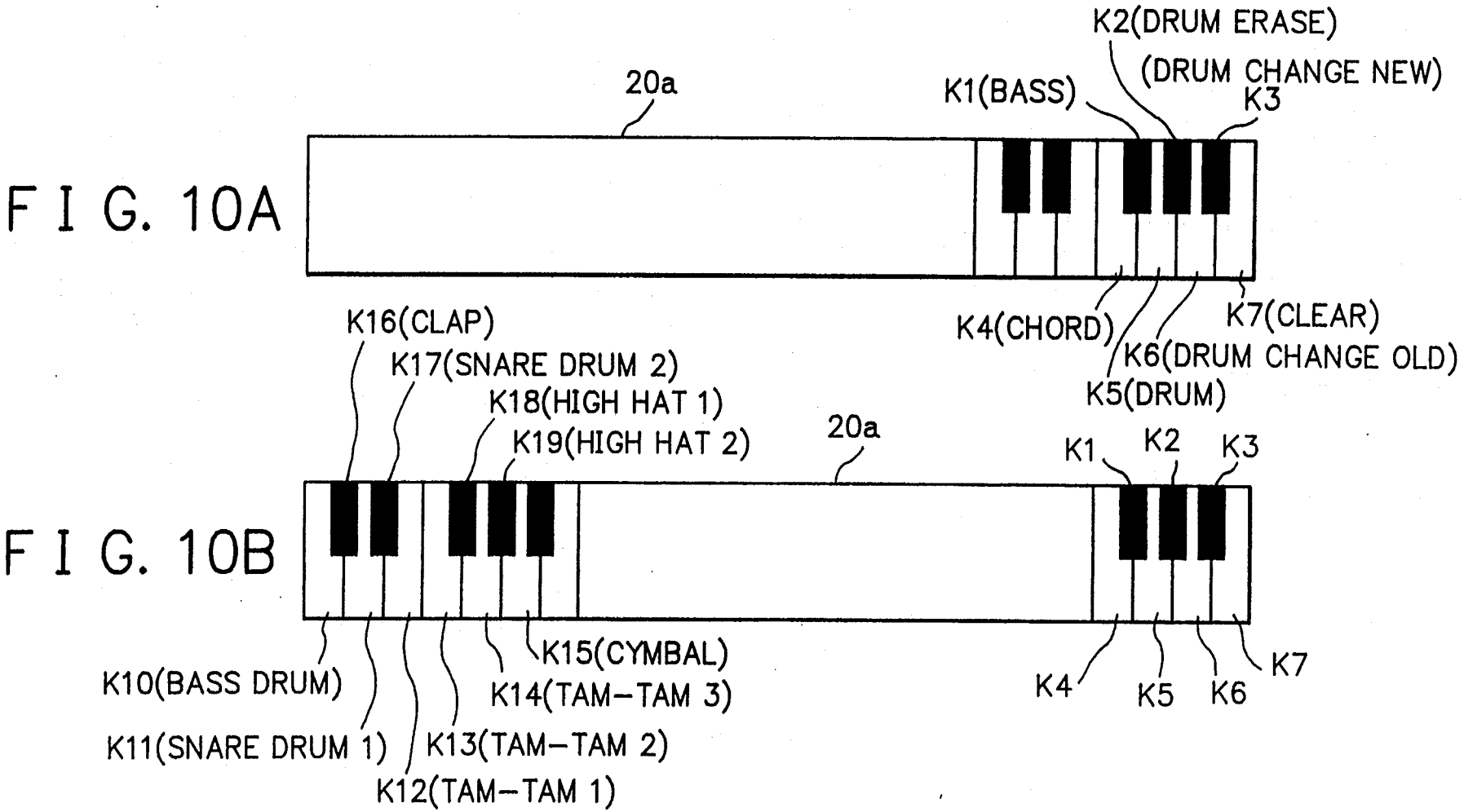
FIGS. 10A and 10B are views showing keyboard portions used in an edit operation.

FIGS. 10A and 10B show the arrangements of keys, used in the edit mode, of a keyboard 20*a* of the electronic musical instrument of this embodiment. Keys K1 to K7 are used for selecting the bass, chord, and drum parts, changing or restoring a drum tone color (NEW-/OLD), erasing (clearing) a part, and so on. Keys K10 to K19 are used for selecting drum tone colors such as a bass drum, a snare drum, a tam-tam, a cymbal, and the like.

Figure 11:
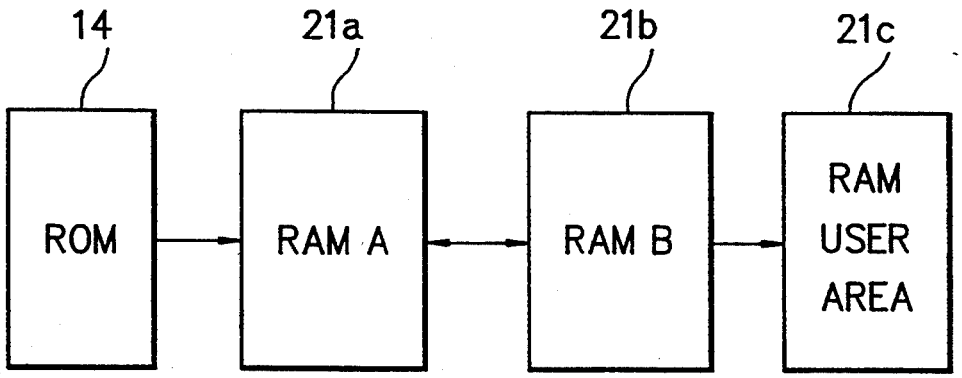
FIG. 11 is a view showing RAM areas used in an edit mode.

FIG. 11 shows the areas of a RAM 21 used for editing an auto-accompaniment intonation pattern. In this case, data to be edited is intonation pattern data programmed in the ROM 14 or auto-accompaniment data programmed in the ROM 16. When the edit switch 19*f* shown in FIG. 9 is depressed, the edit mode is selected, and a sub-pattern to be edited is selected upon operation of the introduction/ending switch 19*c* or the fill-in switch 19*e*. Then, auto-accompaniment note data for four bars of, e.g., an introduction pattern, fill-in pattern, ending pattern, or the like in units of two beats programmed in the ROM 16 are read out from the ROM 16 on the basis of an intonation pattern corresponding to the current rhythm and intonation value set in the intonation value setting unit 11, and are written in a RAM area A (21*a*). The data are transferred from the RAM area 21*a* to a RAM area B (21*b*). Upon completion of this transfer operation, the data are re-transferred from the RAM area 21*b* to the RAM area 21*a*, and the transfer operation is repeated. At the same time, corresponding note data are played back, and tones are generated. At this time, when the keyboard 20*a* is operated at a timing of data to be corrected, 4-byte note data (for one note) corresponding to the operated key is written in the destination RAM area, thus performing data correction by overwriting the data.

When one of the edit keys K1 to K7 shown in FIG. 10A is depressed in the edit mode, as for the chord, bass, and drum channels, the edit mode of an intonation pattern (ROM 14) corresponding to the current intonation value is set. The intonation pattern to be edited is transferred to the RAM area 21*a*. In this state, when one of the keys K10 to K19 (FIG. 10B) corresponding to a drum tone color to be erased is depressed while depressing the drum erase key K2, the data in the corresponding drum track is erased. When one of the drum tone color keys K10 to K19 is depressed while depressing the drum change new key K3, a drum instrument number to be converted is written in the tone color/instrument column of the corresponding drum track. When one of the drum tone color keys K10 to K19 is depressed while depressing the drum change old key K6, an original drum instrument number programmed in the ROM 14 is written in the tone color/instrument column of the corresponding drum track, and the drum track can be restored to an original state.

When one of the volume switches 19*a* shown in FIG. 9 is depressed in the edit mode for the chord, bass, and drum intonation patterns, data in the column of the tone volume difference value VELO of these accompaniment parts is incremented/decremented. Furthermore, when one key of the ten-key pad 19*b* is operated, tone color number data in the tone color/instrument column of a part (chord or bass), which is being edited, can be changed.

Upon completion of the edit operation, when the store switch 19*h* (FIG. 9) is depressed, edited data are transferred from the RAM area 21*a* or 21*b* (FIG. 11) to a user area 21*c* (RAM area) for storing edited data. The user area 21*c* has the same arrangement as that of the intonation pattern table (ROM) 32 shown in FIG. 4, and is assigned with five rhythm Nos. 96 to 100. The edited intonation pattern is written at the position of the current intonation value in the column of the selected rhythm number. Note that the tone control unit 15 is prepared with an intonation edit table (edit identification table) 35, as shown in FIG. 12, and data "1" is written in the column of the intonation value of the edited rhythm number so as to indicate that the edited intonation pattern data is stored in the user area 21*c*.

Figure 13:
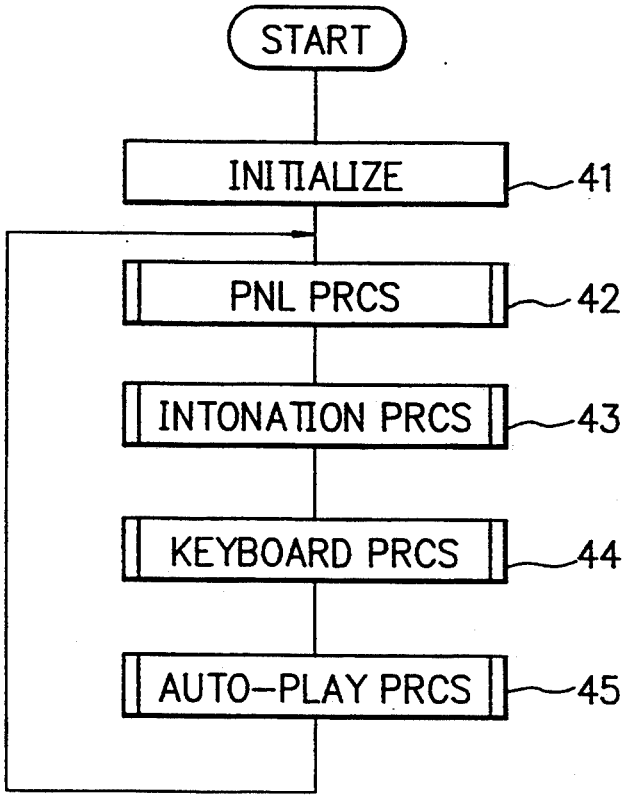
FIG. 13 is a main flow chart showing auto-play control on the basis of the intonation pattern data.

FIGS. 13 to 28 are flow charts showing auto-play control based on intonation pattern data. FIG. 13 shows the general flow. In step 41, initialization is performed. In step 42, panel processing (detection of an operation of the panel switches) is executed. In step 43, intonation value setting processing using the intonation operation unit 12 (intonation dial 12*a*) is executed. In step 44, processing corresponding to an operation on the keyboard 20*a* is executed. In step 45, an auto-play routine is executed. Thereafter, the flow loops to step 42.

Figure 14:
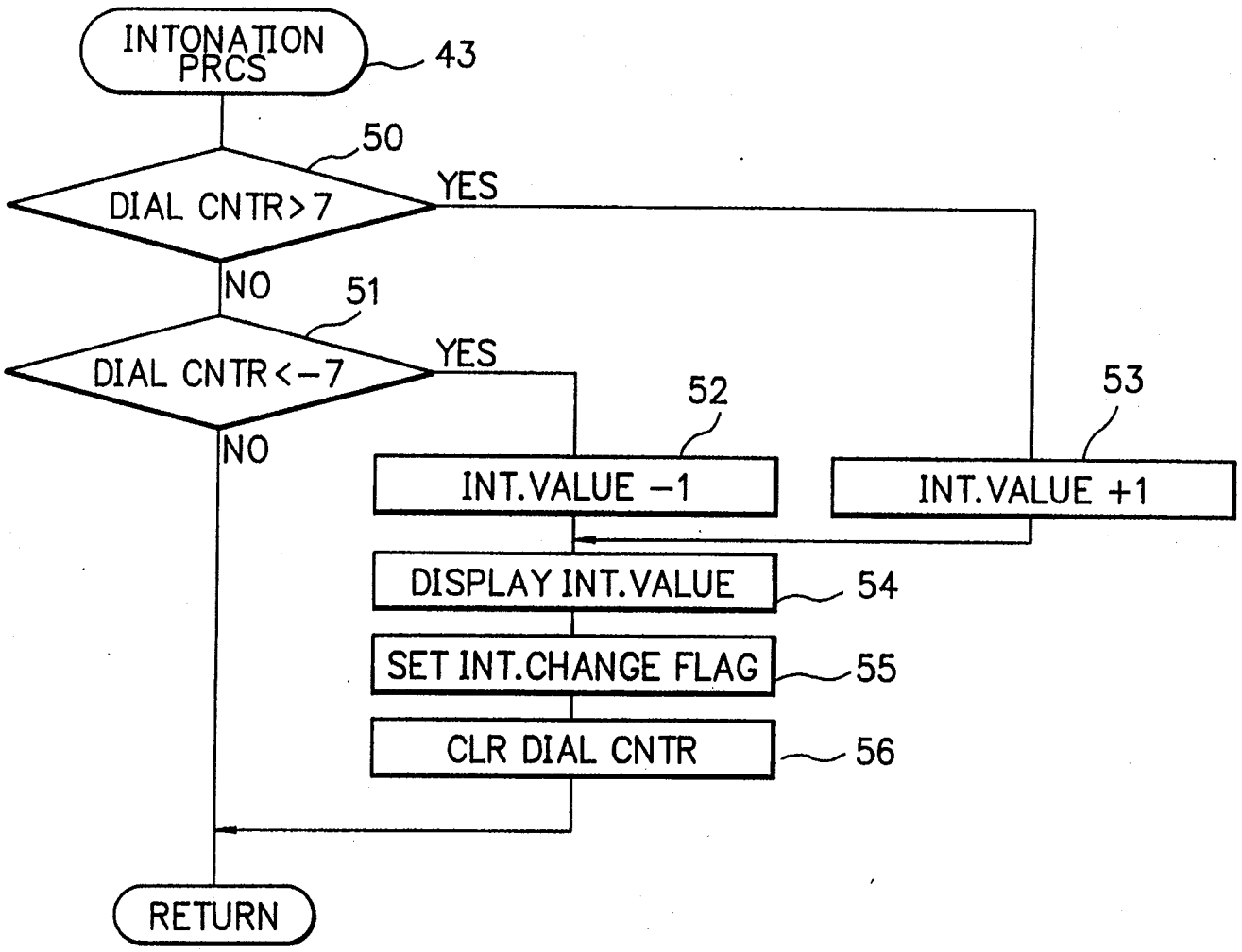
FIG. 14 is a flow chart showing intonation processing.

FIG. 14 shows the intonation processing (step 43). In this processing, an intonation value is changed in response to an operation of the dial 12*a*. In steps 50 and 51, it is checked if the count value of pulses output from the pulse generator 12*b* is larger than 7 or smaller than −7. If YES in step 50, the intonation value is incremented by "1" in step 53; if YES in step 51, the intonation value is decremented by "1" in step 52. Note that about a $\frac{1}{3}$ revolution of the dial 12*a* corresponds to the count value "7". When the dial is turned clockwise, the count value is increased; when the dial is turned counterclockwise, the count value is decreased. In step 54, the intonation value is displayed on a display device (not shown). In step 55, an intonation change flag is set. In step 56, a dial counter is cleared.

Figure 15:
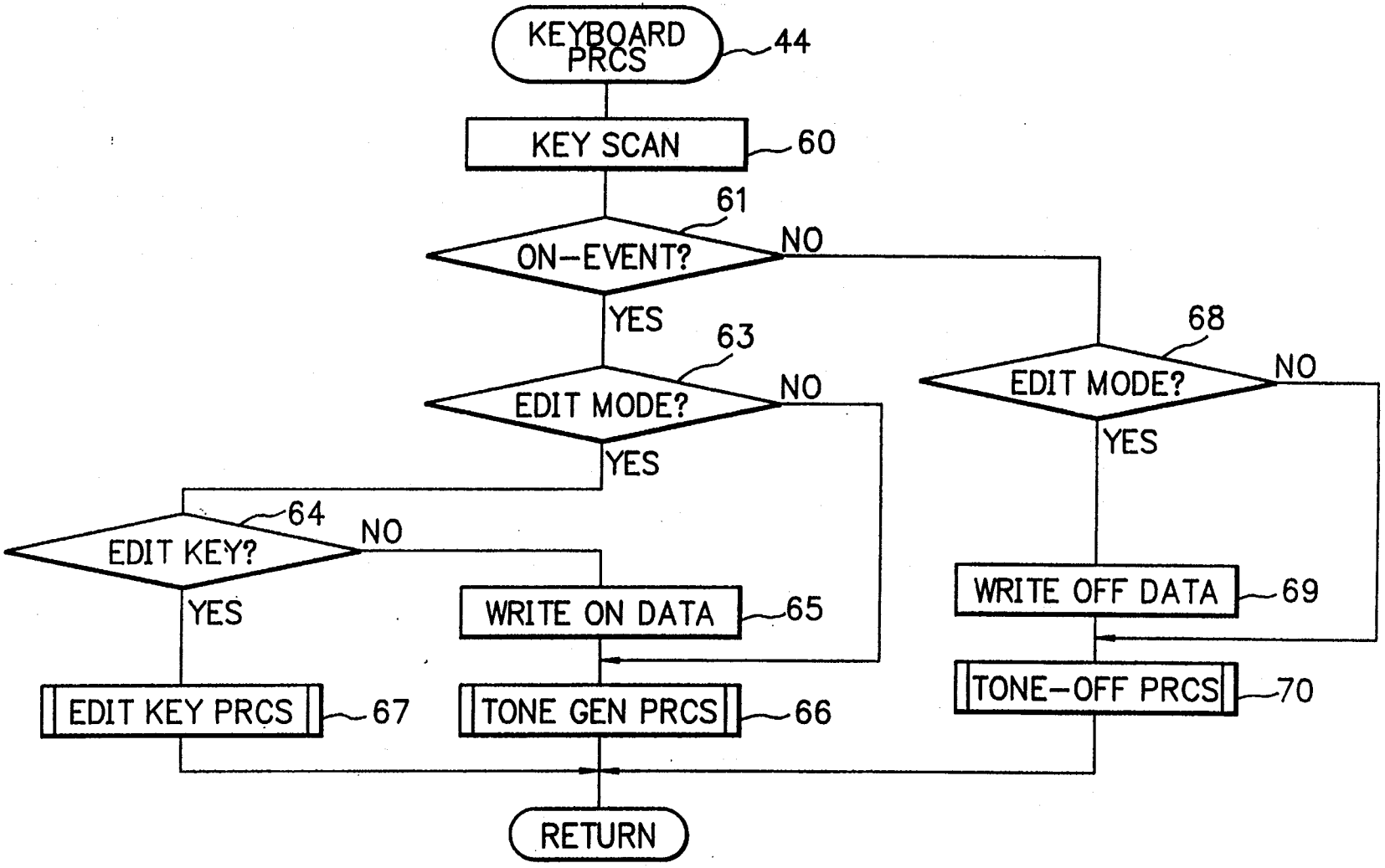
FIG. 15 is a flow chart showing keyboard processing.

FIG. 15 shows the keyboard processing (step 44). In step 60, a key scan is performed. In step 61, an ON-event/OFF-event (key depression/key release) is checked. In step 63 or 68, it is checked if the edit mode is selected. If NO in step 63 or 68, the flow advances to step 66 to execute tone generation processing corresponding to the ON-event, or the flow advances to step 70 to execute tone-OFF processing corresponding to the OFF-event. However, if YES in step 63 or 68, ON or OFF data for one note is written in the work RAM area, which is being edited, in step 65 or 69. If an ON-event is detected in the edit mode, it is checked in step 64 if the ON-event corresponds to one of the edit keys K1 to K7 (FIG. 10A). If YES in step 64, edit key processing (to be described later) is executed in step 67.

Figure 16A:
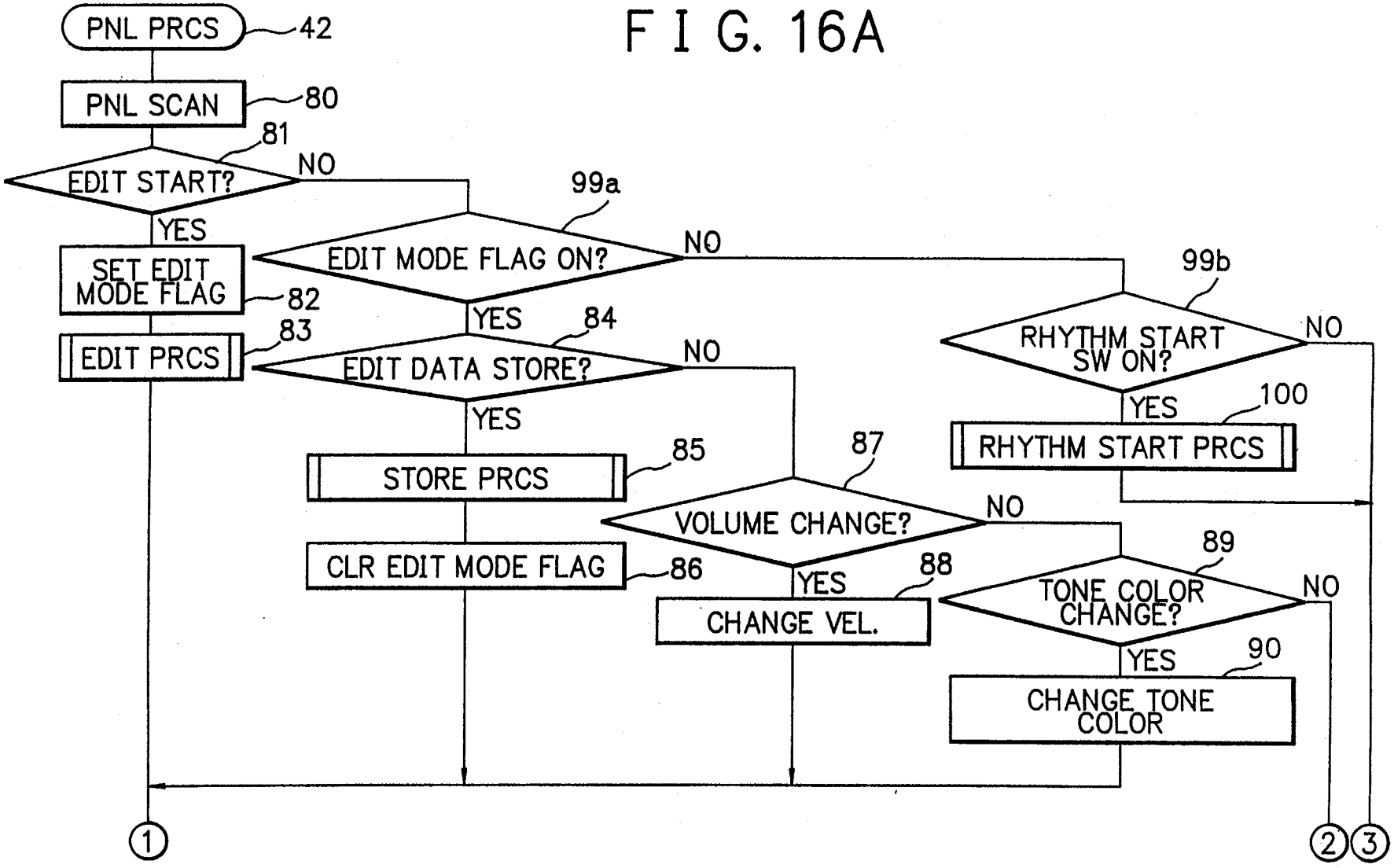
FIGS. 16A and 16B are flow charts showing panel processing.
Figure 16B:
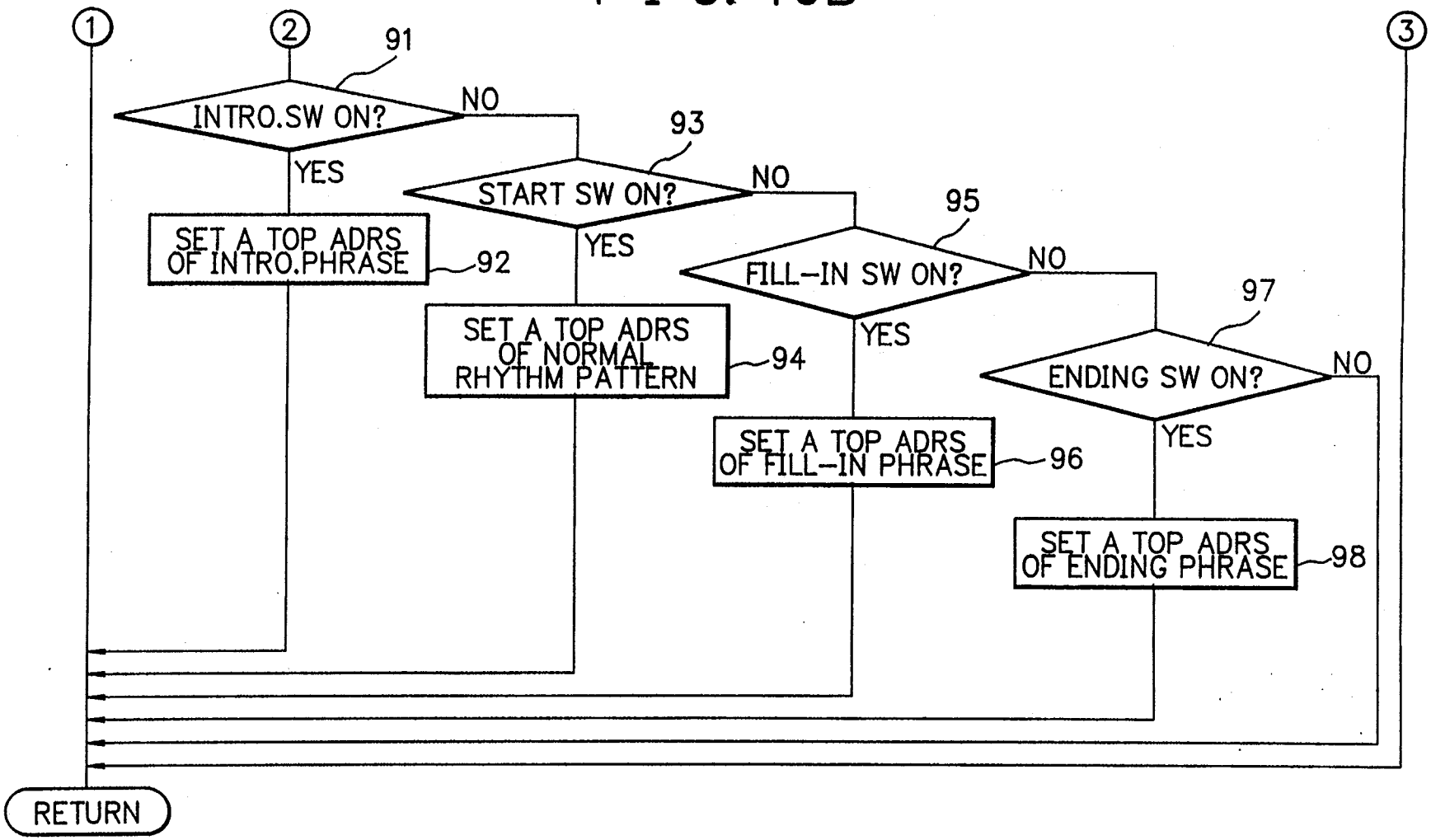

FIGS. 16A and 16B show the panel processing in step 42. In step 80, the panel switches are scanned to detect an operation of the edit switch 19*f*, the store switch 19*h*, the volume switches 19*a*, the ten-key pad 19*b*, the introduction/ending switch 19*c*, the start/stop switch 19*d*, or the fill-in switch 19*e* (FIG. 9). If an ON-event of the edit switch 19*f* is detected in step 81, an edit mode flag is set in step 82, and edit processing (to be described later) is executed in step 83. If NO in step 81, it is checked in step 99*a* if the edit mode flag is ON. If NO in step 99*a*, it is checked in step 99*b* if the rhythm start switch is ON. If YES in step 99*b*, rhythm start processing is executed in step 100, and the flow returns to the main routine; otherwise, the flow directly returns to the main routine. If it is detected in step 99*a* that the edit mode flag is ON, and if it is detected in step 84 that the store switch 19*h* is ON, store processing of edit data is executed in step 85, and the edit mode flag is cleared in step 86. If it is detected in step 87 that one of the volume switches 19*a* is operated, processing for changing data in the column of the tone volume difference value VELO of the intonation pattern is executed in step 88. If it is detected in step 89 that one key of the ten-key pad 19*b* is operated, since the tone color is to be changed, data in the tone color column of the intonation pattern data is changed according to the operated numeric key.

If it is detected in step 91 that the introduction/ending switch 19*c* is ON, the top address of an introduction phrase programmed as the intonation pattern is set so as to allow an edit operation of auto-accompaniment data at that address (step 92). Similarly, if an ON-event of the start/stop switch 19*d*, the fill-in switch 19*e*, or the ending switch 19*c* (alternately used as the introduction switch) is detected in step 93, 95, or 97, the top address of a normal rhythm pattern, a fill-in phrase, or an ending phrase is set in step 94, 96, or 98.

Figure 17:
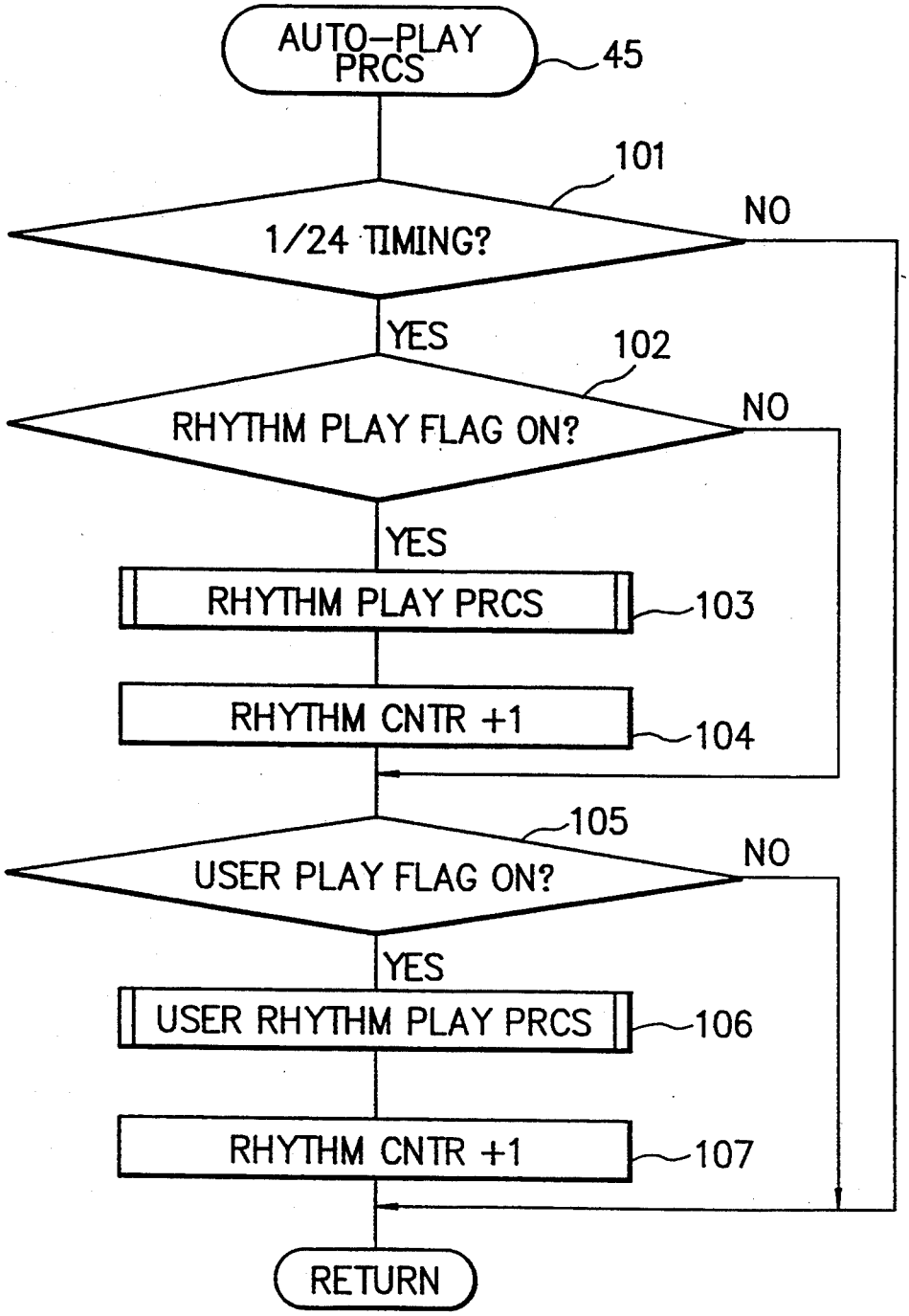
FIG. 17 is a flow chart showing auto-play processing.

FIG. 17 shows the auto-play processing in step 45. In step 101, it is checked if the tone generation timing (time obtained by frequency-dividing a tempo clock to 1/24) is reached. If YES in step 101, it is checked in step 102 if a rhythm play flag is ON. If YES in step 102, rhythm play processing is executed in step 103, and the content of a rhythm counter for counting beats is incremented by "1" in step 104. Furthermore, it is checked in step 105 if a user play flag is ON. If YES in step 105, play processing of rhythm accompaniment data edited by a user is executed in step 106, and the content of the rhythm counter is incremented by "1" in step 107.

Figure 18:
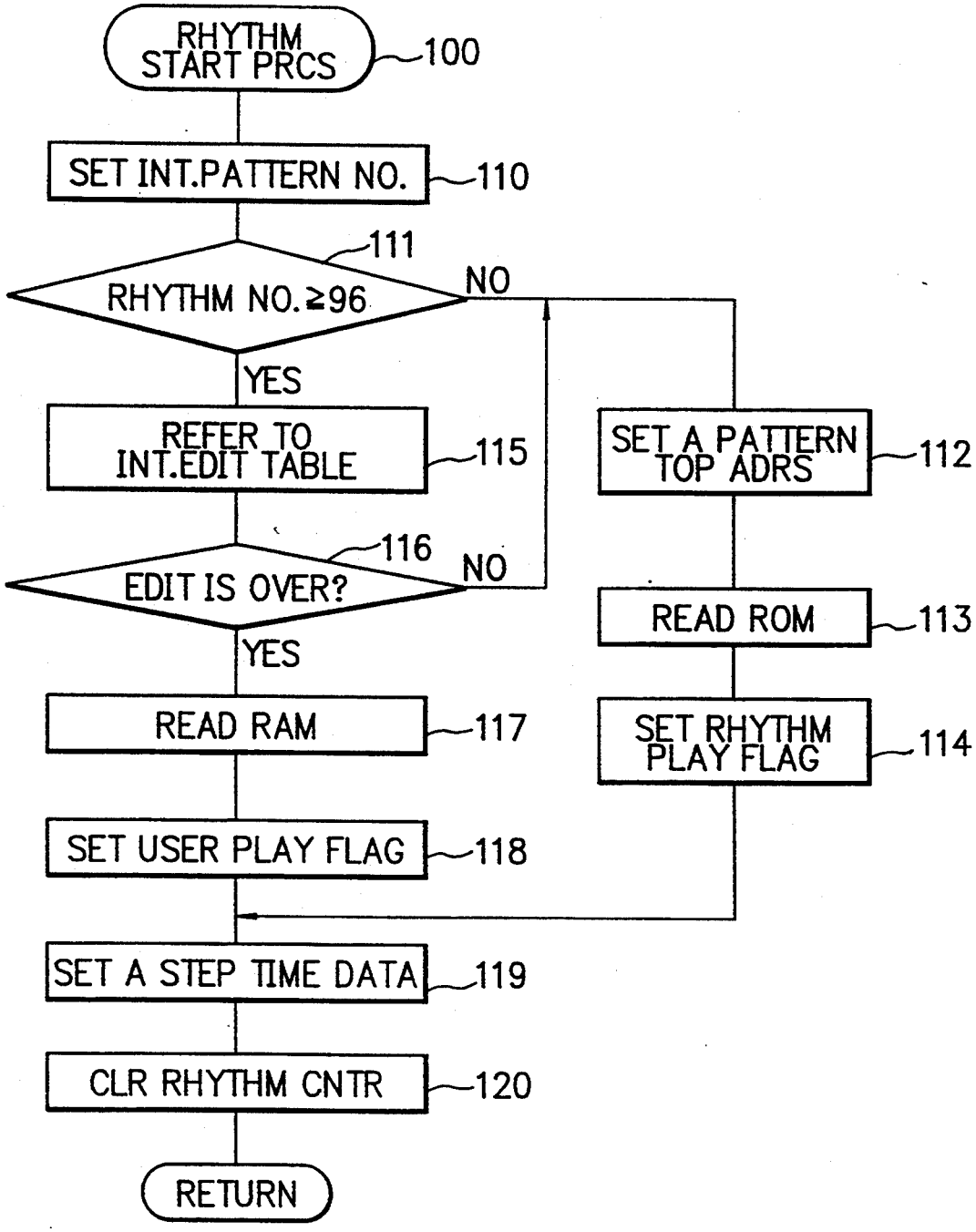
FIG. 18 is a flow chart showing rhythm start processing.

FIG. 18 shows the rhythm start processing in step 100 in FIG. 16A. In step 110, the current intonation value (intonation pattern number) is set, and it is checked in step 111 if the current rhythm number is equal to or larger than 96 (user area). If NO in step 111, the top address of an auto-accompaniment pattern programmed in the intonation pattern is set in step 112. Data is read out from the address set in step 112 of the ROM 16 in step 113, and a rhythm play flag is set in step 114. Thereafter, step time data of the note data read out from the ROM 16 is set in step 119, and the rhythm counter is cleared in step 120, thus ending the rhythm start processing.

If it is detected in step 111 that the rhythm number is equal to or larger than 96, the intonation edit table 35 (FIG. 12) is referred to in step 115, and it is checked in step 116 if the corresponding intonation value position is edited. If NO in step 116, a rhythm accompaniment operation is executed based on ROM data in step 112 and subsequent steps; otherwise, the top address of auto-accompaniment pattern data is read out from the user area 21c of the RAM in step 117, a user play flag is set in step 118, and the flow then advances to step 119.

Figure 19:
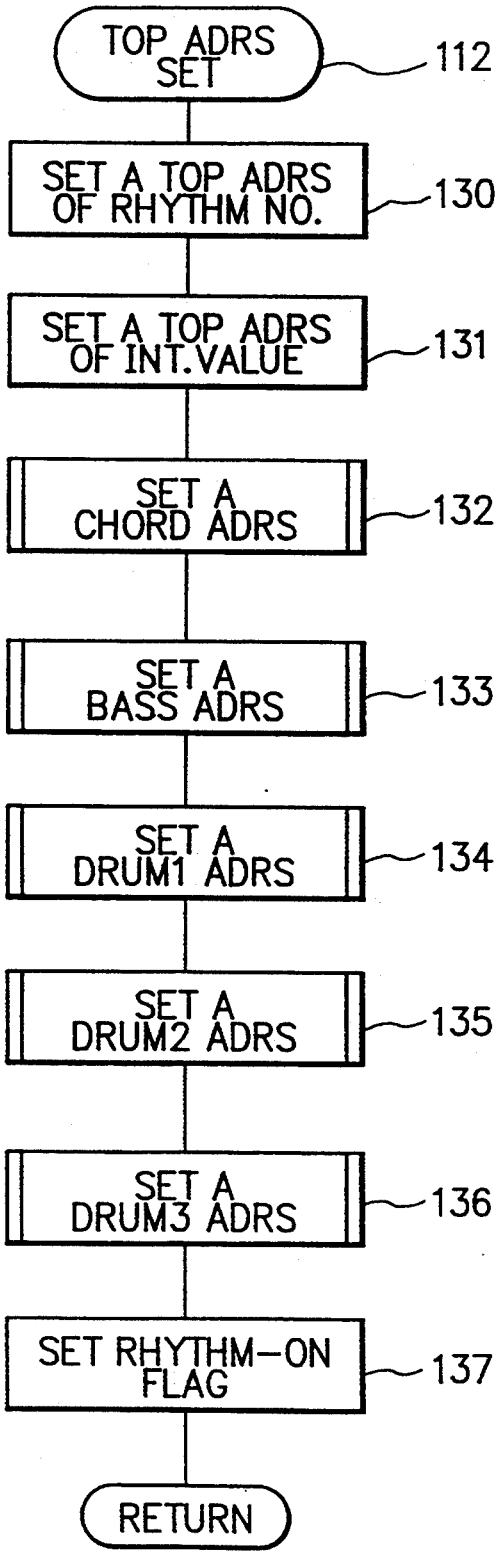
FIG. 19 is a flow chart showing a tone address set routine.

FIG. 19 shows the details of the top address set routine in step 112 in FIG. 18. The top address of the intonation pattern table 32 corresponding to the rhythm number is set in step 130, and the top address of intonation pattern data designated by the current intonation value is set in step 131. In steps 132 to 136, the read addresses programmed in the play pattern portion of the intonation pattern data for the five tracks, i.e., chord, bass, and drum1 to drum3 tracks, are set, and the corresponding data are read out to buffers. In step 137, a rhythm ON flag is set.

Figure 20:
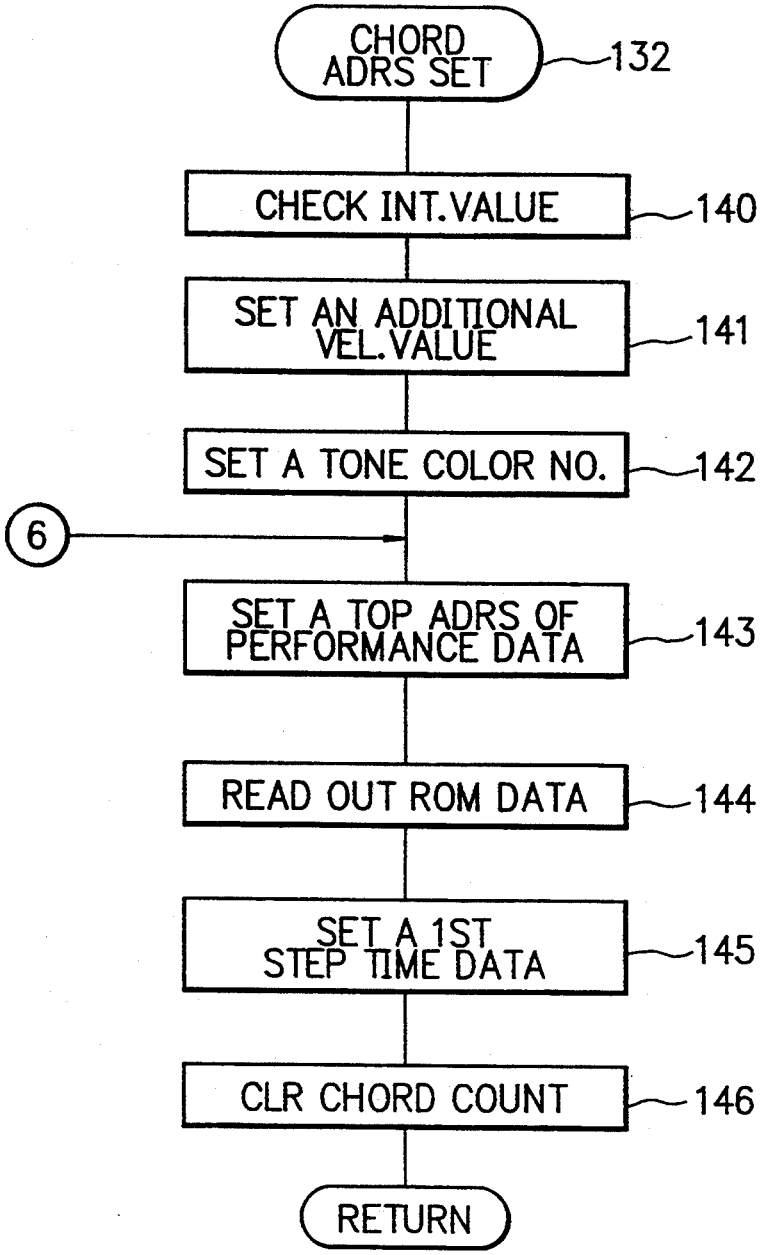
FIG. 20 is a flow chart showing a chord address set routine.

FIG. 20 shows the details of the chord address set routine in step 132 in FIG. 19. In this processing, the current intonation value is checked in step 140, and the tone volume difference data of the intonation pattern data is set as an additional velocity value in step 141. Then, the tone color number written in the chord track of the intonation pattern data is set in step 142, and the top address of accompaniment pattern data is set in step 143. In step 144, one note data, corresponding to the top address of auto-accompaniment pattern data, is read out from the ROM 16, and in step 145, first step time data is set in a buffer. In step 146, a chord time base counter value is cleared, and the flow returns to the routine shown in FIG. 19. Steps 133 to 136 in FIG. 19 corresponding to other channels are executed in the same manner as described above.

Figure 21:
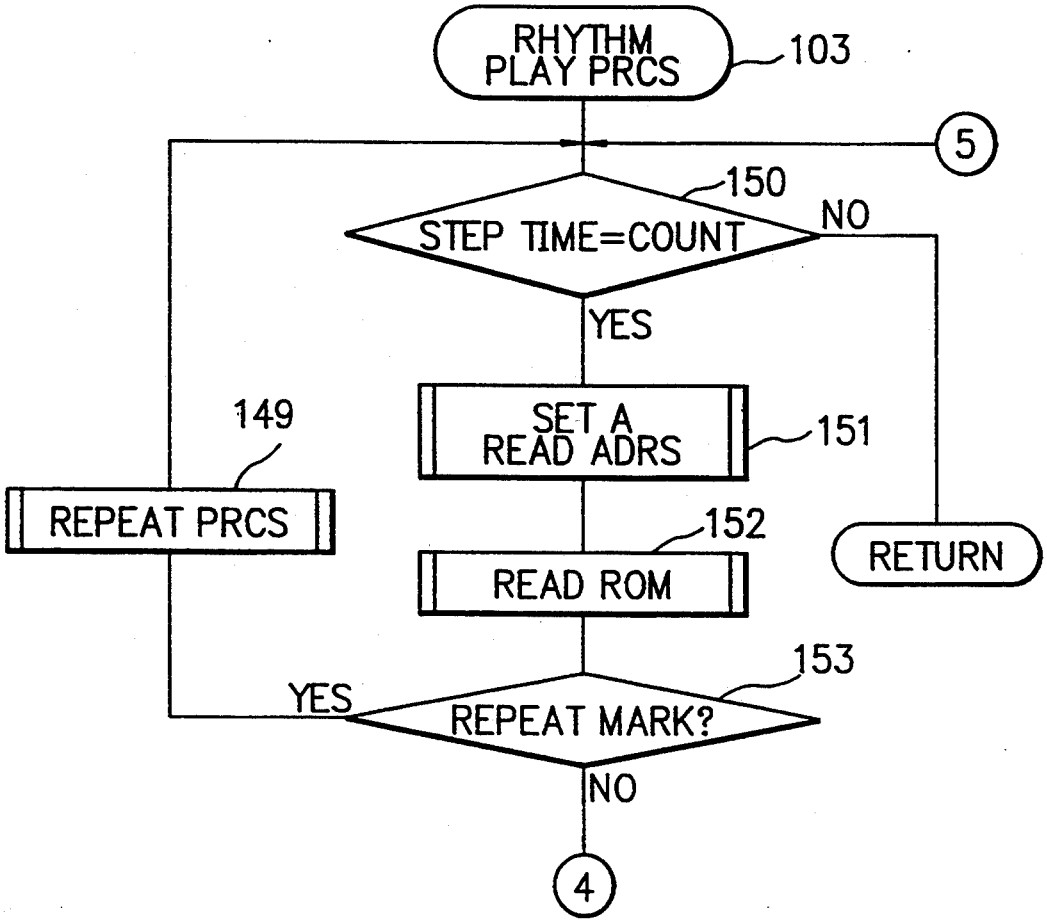
FIG. 21 is a flow chart showing rhythm play processing.
Figure 22:
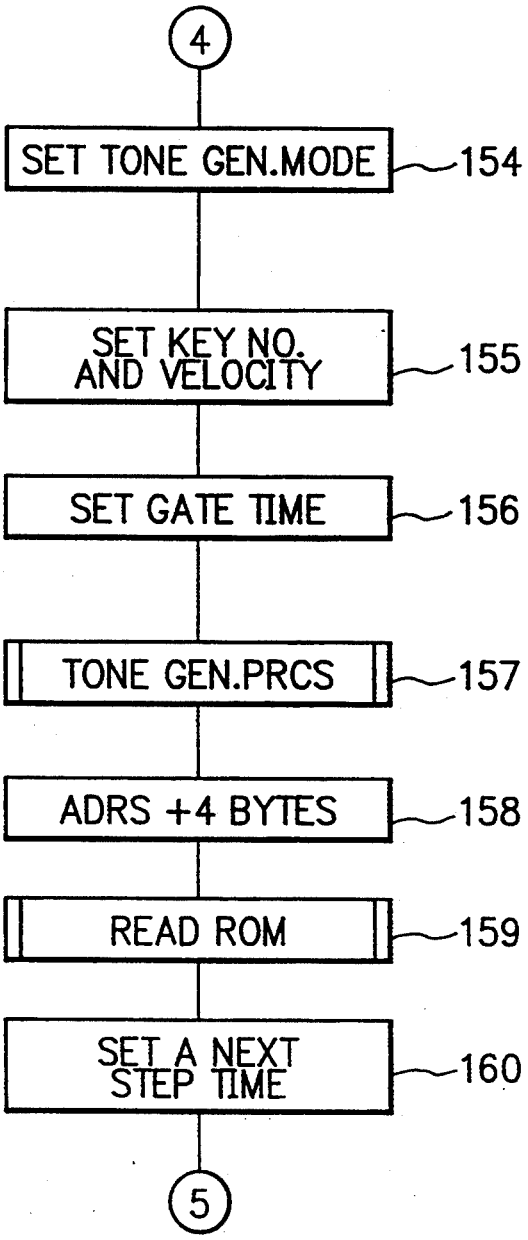
FIG. 22 is a flow chart showing the rhythm play processing.

FIGS. 21 and 22 show the details of the rhythm play processing executed in step 103 in FIG. 17. In this routine, it is checked in step 150 if the count value of the time base counter coincides with the step time of a first tone in the buffer. If NO in step 150, the flow returns to the main routine. If it is determined in step 150 that the count value of the time base counter coincides with the step time, the read address of a note to be generated is set (step 151), and 4-byte note data is read out from the ROM 16 (step 152). It is then checked in step 153 if the readout note data is a repeat mark. If YES in step 153, repeat processing is executed in step 149, and the flow returns to the node before step 150. If it is determined in step 153 that the readout note data is normal note data, the flow advances to step 154 (FIG. 22) to set a tone generation mode.

In steps 155 and 156, the key number and the velocity value, and the gate time are respectively set, and in step 157, tone generation processing of a corresponding note is executed. Upon completion of the tone generation processing, the read address is incremented by four bytes in step 158, and note data to be generated next is read out from the ROM 16 in step 159. In step 160, the next step time is set in a buffer, and the flow returns to the beginning of the rhythm play routine in FIG. 21. In this manner, tones of an auto-accompaniment are sequentially produced by repeating this processing.

Figure 23:
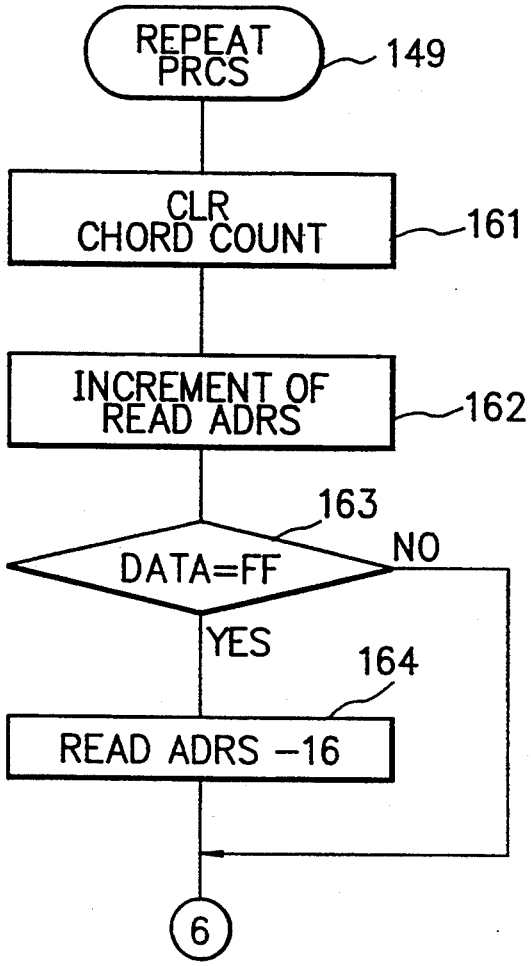
FIG. 23 is a flow chart showing repeat processing.

If it is determined in step 153 (FIG. 21) that a repeat mark is detected at the end of note data, the flow advances to step 149, and repeat processing shown in FIG. 23 is executed. In this routine, the time base chord counter is cleared in step 161, and the read address of the intonation pattern is incremented by 1 in step 162. It is checked in step 163 if the current auto-accompaniment pattern data is a repeat mark REP (FFH) shown in FIGS. 6 and 7. If NO in step 163, the flow returns to step 143 (FIG. 20), and the top address of auto-accompaniment pattern data of the second bar is set, thus continuing the read-out operation of note data.

If a repeat mark REP (FFH) is detected in step 163 (FIG. 23), "16" (for four bars) is subtracted from the read address of the intonation pattern data in step 164 to return the read position to the first beat of the first bar, and the note data read-out operation is continued from step 143 (FIG. 20).

Figure 24:
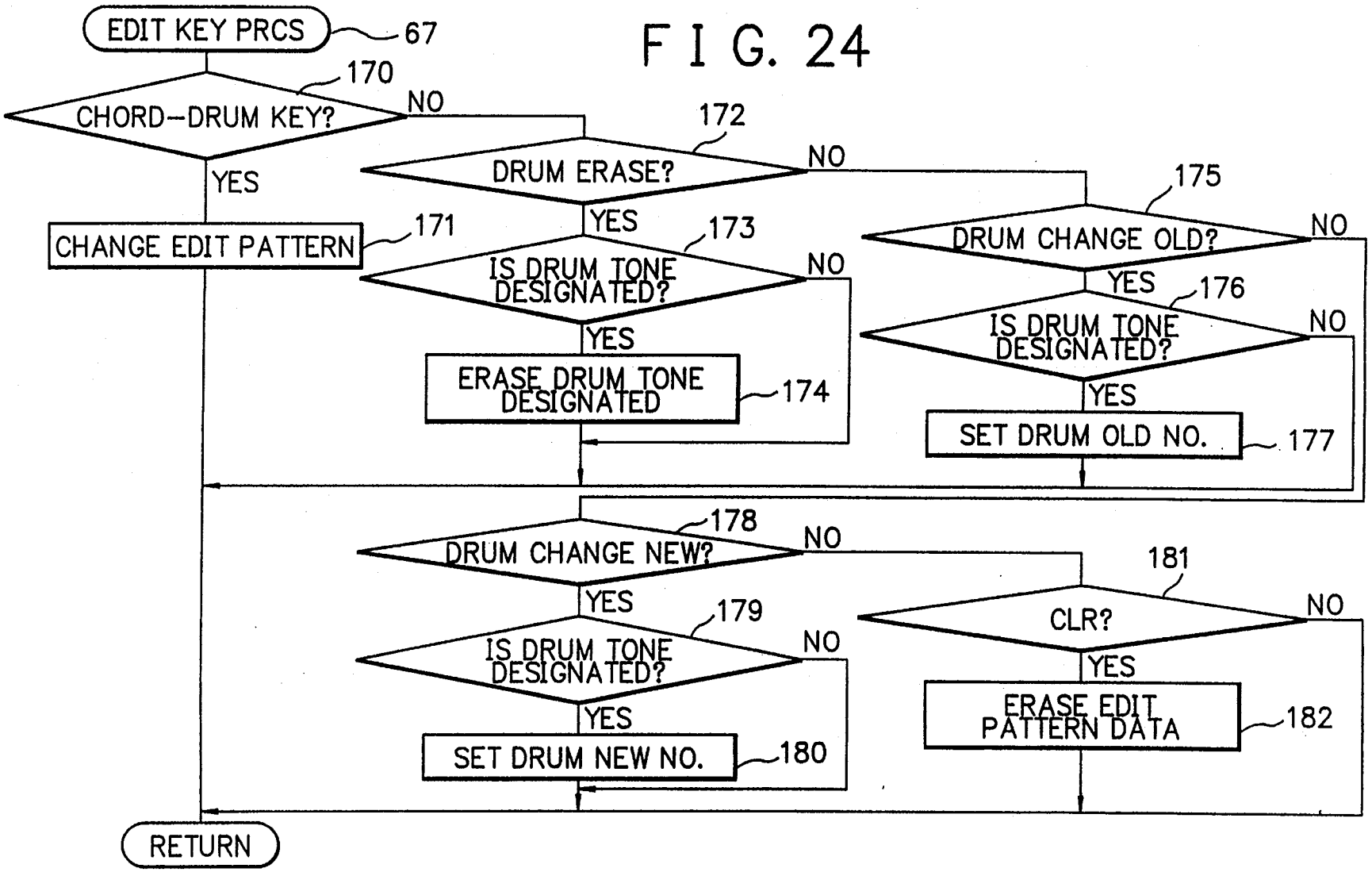
FIG. 24 is a flow chart showing edit key processing.

FIG. 24 shows the details of the edit key processing in step 67 in FIG. 15. In steps 170, 172, 175, 178, and 181, the operations of the edit keys K1 to K7 are checked. If the operation of one of the chord, bass, drum keys K1, K4, and K5 is detected, processing for changing an edit pattern is executed in step 171. If the operation of the drum erase key K2 is detected, it is checked in step 173 if the drum tone (K10 to K19) is designated. If YES in step 173, the designated drum tone is erased from the corresponding drum track of the intonation pattern data in step 174. If the operation of the drum change old key K6 is detected, it is checked in step 176 if the drum tone is designated. If YES in step 176, an original (old setting value) number is set as a drum tone number in the corresponding drum track of the intonation pattern data.

If the operation of the drum change new key K3 is detected, it is checked in step 179 if the drum tone is designated. If YES in step 179, the designated drum tone color number is set in the corresponding drum track of the intonation pattern data in step 180. Furthermore, if the operation of the clear key K7 is detected, the edit pattern, which is being edited, is erased in step 182.

Figure 25:
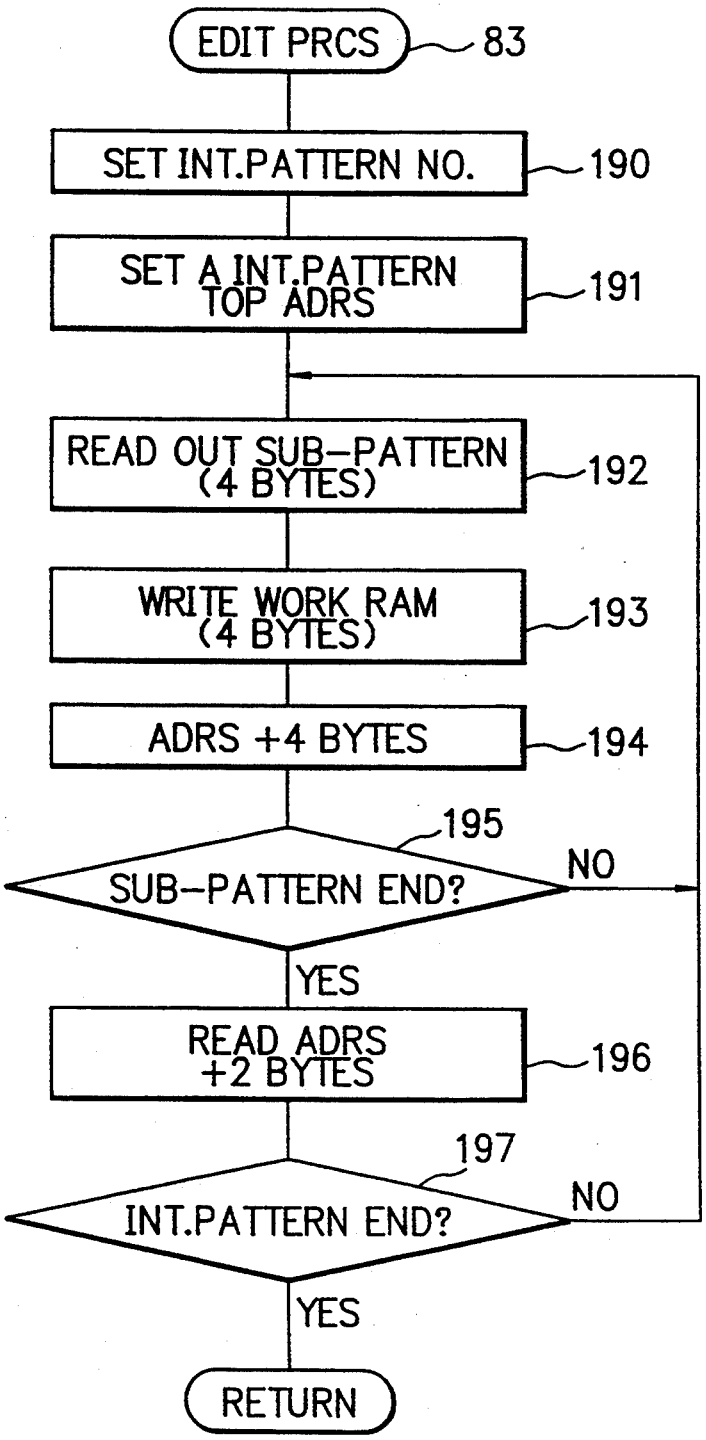
FIG. 25 is a flow chart showing edit processing.

FIG. 25 shows the details of the edit processing in step 83 in FIG. 16A. In step 190, the current intonation value (number) to be edited is set. In step 191, the top address of play pattern data programmed in the intonation pattern is set. A sub-pattern (auto-play data) for four bytes (one note) at the corresponding address is read out from the ROM in step 192, and the 4-byte data is written in the edit work RAM in step 193. In step 194, the address is incremented by four bytes to read out the next data. In step 195, it is checked if the end of the sub-pattern is reached. If NO in step 195, the flow returns to step 192 to repeat the above-mentioned processing.

If the end of the sub-pattern is detected in step 195, the read address of the intonation pattern is incremented by 2 bytes in step 196, and data in the next bar is checked in step 197. If it is determined in step 197 that the next data is not an end mark of the intonation pattern, the read-out operation of the sub-pattern is continued from step 192. If the end mark is detected in step 197, the transfer operation of the sub-pattern to the RAM is ended.

Figure 26:
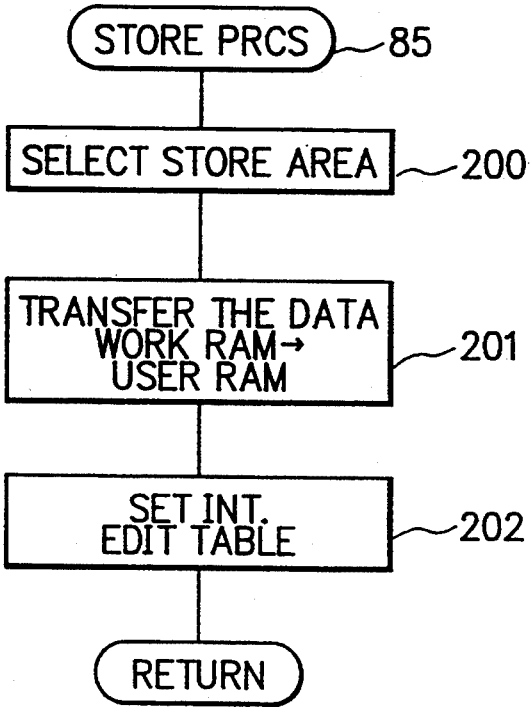
FIG. 26 is a flow chart showing store processing.

FIG. 26 shows the details of the store processing in step 85 in FIG. 16A. In step 200, the storage position (rhythm Nos. 96 to 100) of the user area 21c is selected, and in step 201, edit data is transferred from the work RAM area to the user RAM area. In step 202, data "1" indicating that the data is edited is written in the intonation edit table 35 shown in FIG. 12.

Figure 27:
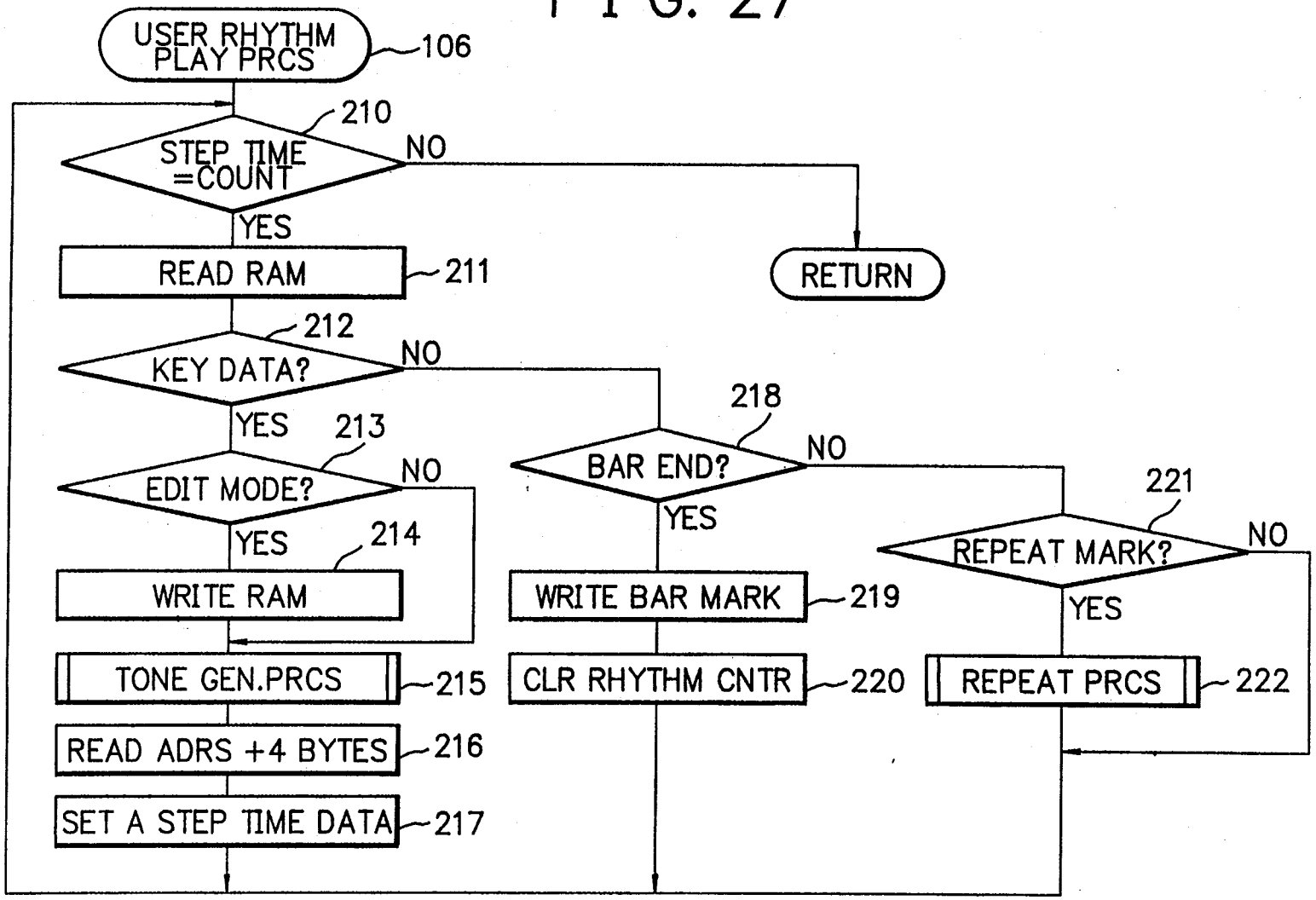
FIG. 27 is a flow chart showing user rhythm play processing.

FIG. 27 shows the details of user rhythm play processing in step 106 in FIG. 17. In step 210, it is checked if the count value of the time base counter coincides with the step time of the first tone to be generated in the buffer. If NO in step 210, the flow returns to the main routine. If it is determined in step 210 that the count value of the time base counter coincides with the step time, the read address of a note to be generated is set, and 4-byte note data is read out from the work RAM (step 211). It is then checked in step 212 if the data read out in step 211 is key (note) data. If YES in step 212, it is checked in step 213 if the edit mode is selected. If YES in step 213, key data is transferred to and written in another area (one of the areas 21*a* and 21*b* in FIG. 11) of the work RAM in step 214. In step 215, tone generation processing of the current note is executed in step 216, the read address is incremented by four bytes, and in step 217, the next step data is set in the buffer.

If data other than the key data is detected in step 212 in FIG. 27, it is checked in steps 218 and 221 if the readout data is a bar end mark or a repeat mark. If a bar end mark is detected, a bar mark is written in the destination RAM area in step 219, and the rhythm counter is cleared in step 220. If a repeat mark is detected, repeat processing is executed in step 222.

Figure 28:
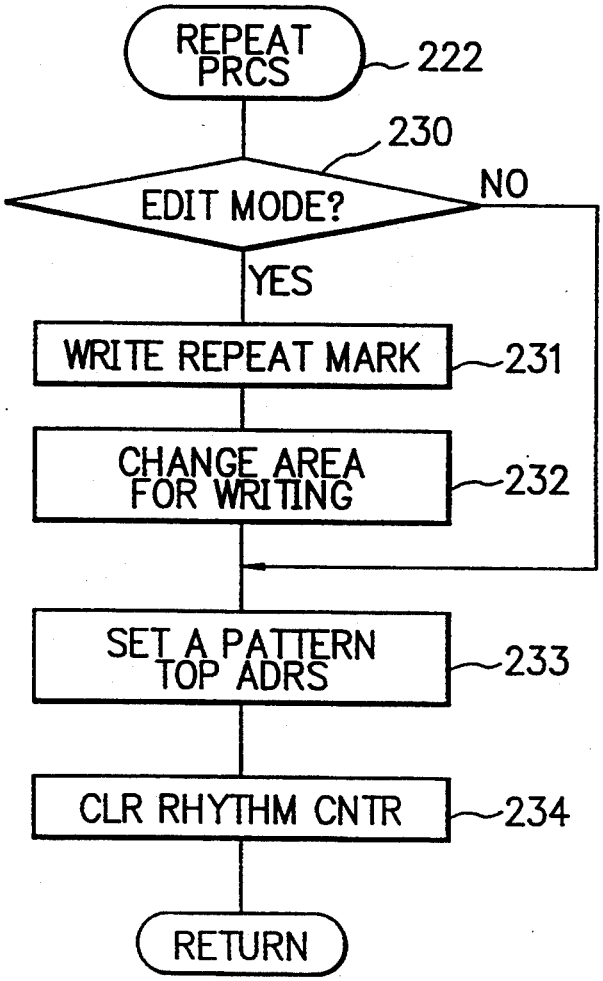
FIG. 28 is a flow chart showing repeat processing.

FIG. 28 shows the details of the repeat processing in step 222 in FIG. 27. It is checked in step 230 if the edit mode is selected. If YES in step 230, a repeat mark is written in the destination RAM area in step 231, and a write area to which data is to be transferred is switched from one of the RAM areas 21*a* and 21*b* (FIG. 11) to the other in step 232 so as to prepare for the next transfer operation. In step 233, the top address of the intonation pattern, which is being edited, is set, and in step 234, the rhythm counter is cleared. Upon completion of the repeat processing, the flow returns to step 210 in FIG. 27, and tone generation processing is executed while transferring data.

As described above, according to the present invention, auto-accompaniment tones according to the degree of tone-up can be obtained by designating the degree of tone-up of a performance using an operation unit, and a basic auto-accompaniment pattern can be easily developed by a simple edit operation. Therefore, an auto-accompaniment pattern according to the degree of tone-up can be desirably set by editing auto-accompaniment data. Thus, an auto-play apparatus, which can obtain accompaniment tones according to a player's preference are provided.

What is claimed is:

1. An auto-play apparatus comprising:

note data memory means for storing an auto-accompaniment note data string;

tone generation means for generating a tone on the basis of the note data string read from said note data memory means;

intonation pattern memory means for storing intonation patterns of different levels corresponding to degrees of tone-up of a performance;

intonation value setting means for setting an intonation value corresponding to the different levels; and tone control means for controlling the note data string read from said note data memory means on the basis of tone intonation patterns corresponding to the set intonation value, and outputting the note data string to said tone generation means, wherein the tone intonation patterns of different levels include at least one of designation information for designating different read positions in said note data memory means, different tone volume information, different tone color information, and different instrument information to be applied to the note data string read from said note data memory means, and said tone control means includes edit means for editing the tone intonation patterns.

2. The apparatus of claim 1, further comprising edit operation means including input means for inputting the different tone volume information, the different tone color information, and the different instrument information.

3. The apparatus of claim 1, further comprising:

a ROM for storing the intonation patterns and the accompaniment note data string; and a RAM for storing the intonation patterns edited by said edit means.

4. The apparatus of claim 1, wherein said tone control means includes an identification table indicating, in units of intonation levels, whether the intonation patterns are edited.

5. The apparatus of claim 1, wherein said intonation value setting means includes operation means for incrementing/decrementing the set intonation value.

6. The apparatus of claim 1, each intonation pattern including chord, bass, and drum tones.

7. The apparatus of claim 1, wherein the different tone volume information is a difference value to be added to tone volume information of the note data string read from said note data memory means.

8. The apparatus of claim 1, wherein the different instrument information includes intonation pattern data tracks assigned to a drum type.

9. The apparatus of claim 8, wherein the intonation pattern data tracks assigned to a drum type include instrument conversion information having new instrument type data and current instrument type data of the note data string read from said note data memory means, wherein said current instrument type data of the note data string of the note data memory means is replaced with said new instrument type data.

* * * * *